US005944155A

United States Patent [19]

Geary

[11] Patent Number: 5,944,155

[45] Date of Patent: Aug. 31, 1999

[54] LUGGAGE PIECE WITH REMOVABLE TOTE BAG

[75] Inventor: Rebecca T. Geary, Oak Bluff, Mass.

[73] Assignee: The Gem Group, Inc., Lawrence, Mass.

[21] Appl. No.: 08/999,107

[22] Filed: Dec. 29, 1997

[51] Int. Cl.[6] ..... A45C 5/14; A45C 13/10; A45C 5/06

[52] U.S. Cl. ..... 190/108; 190/18 A; 190/110; 150/111; 383/37

[58] Field of Search ..... 190/108, 110; 150/111; 383/37

[56] References Cited

U.S. PATENT DOCUMENTS

| | | | |
|---|---|---|---|
| 2,672,903 | 3/1954 | Machinist | 150/111 |
| 3,122,225 | 2/1964 | Ward | 190/108 |
| 3,989,080 | 11/1976 | Koszegi | 383/97 X |
| 4,081,061 | 3/1978 | Tucker | 190/108 |
| 4,236,657 | 12/1980 | Brunton | 190/111 X |
| 4,436,189 | 3/1984 | Baum | 190/108 |
| 4,729,460 | 3/1988 | Kim | 190/111 X |
| 4,756,394 | 7/1988 | Cohen | 190/108 X |
| 4,995,436 | 2/1991 | Cantor | 190/110 X |
| 5,311,972 | 5/1994 | Plath | 190/108 X |
| 5,509,515 | 4/1996 | Guo | 190/110 |
| 5,547,052 | 8/1996 | Latshaw | 190/108 |
| 5,749,503 | 5/1998 | Wulf et al. | 190/18 A X |

FOREIGN PATENT DOCUMENTS

| | | | |
|---|---|---|---|
| 698167 | 10/1953 | United Kingdom | 383/37 |
| 2260894 | 5/1993 | United Kingdom | 383/37 |

*Primary Examiner*—Sue A. Weaver

[57] ABSTRACT

A luggage piece having a detachable tote bag is provided. The luggage piece includes a plurality of sides that enclose a main luggage compartment. The tote bag is secured to the exterior of one of the sides by a zipper. One half of the zipper is secured to a portion of the outer perimeter of the luggage piece side while the other half of the zipper is secured to the outer perimeter of a portion of the tote bag. The top of the tote bag remains unzipped to defining an opening, and can be secured by a snap. A pair of loop handles are located at the opening and can be stowed inside the tote bag when it is attached to the luggage piece. A removable hook is provided to a top side of the luggage piece for hanging the handles therefrom.

9 Claims, 4 Drawing Sheets

LUGGAGE PIECE WITH REMOVABLE TOTE BAG

FIELD OF THE INVENTION

This invention relates to luggage and more particularly to a carry-on style luggage piece.

BACKGROUND OF THE INVENTION

Lightweight luggage configured in a carry-on style has become increasingly popular with travelers. Recent examples of such luggage include wheels, retractable pull handles and a variety of pockets. Such luggage is usually soft-sided or semi-soft-sided, having a fabric covering over a rigid frame structure. Covering materials include canvas, Cordura®, and other synthetics are often used. This luggage is durable and it is sized specifically to fit in an overhead rack or cabin storage compartment of an airplane or other conveyance.

Improvements that increase the versatility of such lightweight luggage pieces are generally desirable.

It is, therefore, an object of this invention to provide an improved carry-on-style luggage piece having incorporated therein a removable tote bag. The tote bag should be readily available, without need of opening the luggage piece. The bag should be easily removable and attachable to the luggage piece.

SUMMARY OF THE INVENTION

This invention provides a versatile arrangement for a luggage piece that includes a detachable tote bag that is removably secured to an exterior side of the one of the sides of the luggage piece. The luggage piece includes a plurality of sides that enclose a main luggage compartment. The tote bag is secured to the exterior of one of the sided by a continuous zipper in a preferred embodiment. One half of the zipper is secured to a portion of the outer perimeter of the luggage piece side while the other half of the zipper is secured to the outer perimeter of a portion of the tote bag. The top of the tote bag remains unzipped to defining an opening, and can be secured by a snap to maintain it closed when desired. further snap can be provided adjacent the opening of the tote bag to secure the tote bag to the side of the luggage piece when it is otherwise zippered to the side. A pair of loop handles are located at the opening and can be stowed inside the tote bag when it is attached to the luggage piece. A removable hook is provided to a top face of the luggage piece for hanging the handles therefrom. The hook includes a spring clip that is detachably secured to a ring mounted on a top side of the luggage piece.

The tote bag is preferably mounted to the lower front panel of the luggage piece. An outer zipper enables the front panel to be separated from the main body of the luggage piece for access to the luggage compartment. The bottom side of the luggage piece can include wheels, preferably adjacent the rear side. A retractable pull handle can be provided, preferably along the rear side, near the top side. A variety of outer pockets and compartments can be provided to the luggage piece.

BRIEF DESCRIPTION OF THE DRAWINGS

The foregoing and other objects and advantages of the invention will become more clear with reference to the following detailed description, as illustrated by the drawings in which.

DETAILED DESCRIPTION OF AN ILLUSTRATIVE EMBODIMENT

Figure 1:
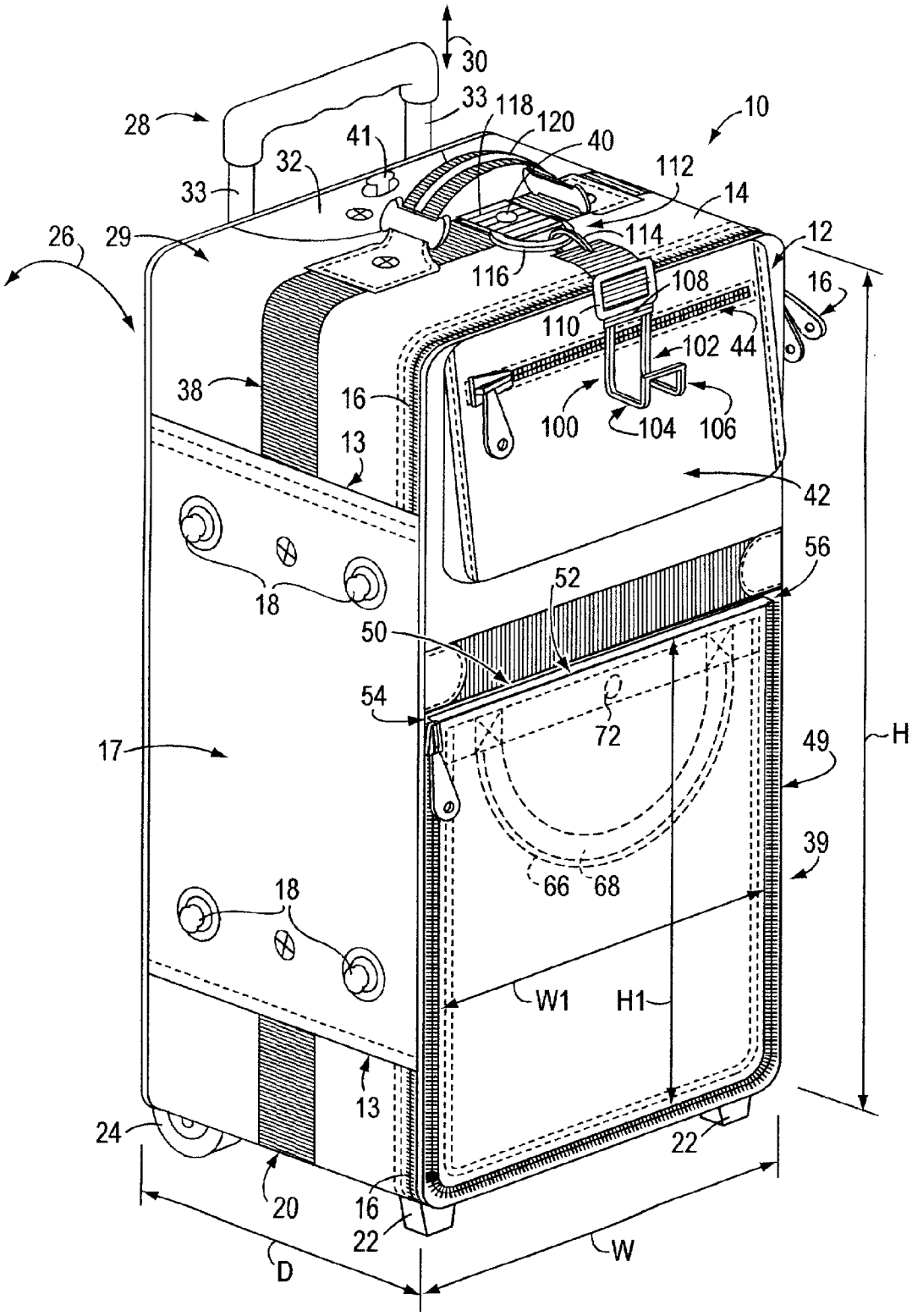
FIG. 1 is perspective view of a luggage piece having a detachable tote bag according to this invention.
Figure 2:
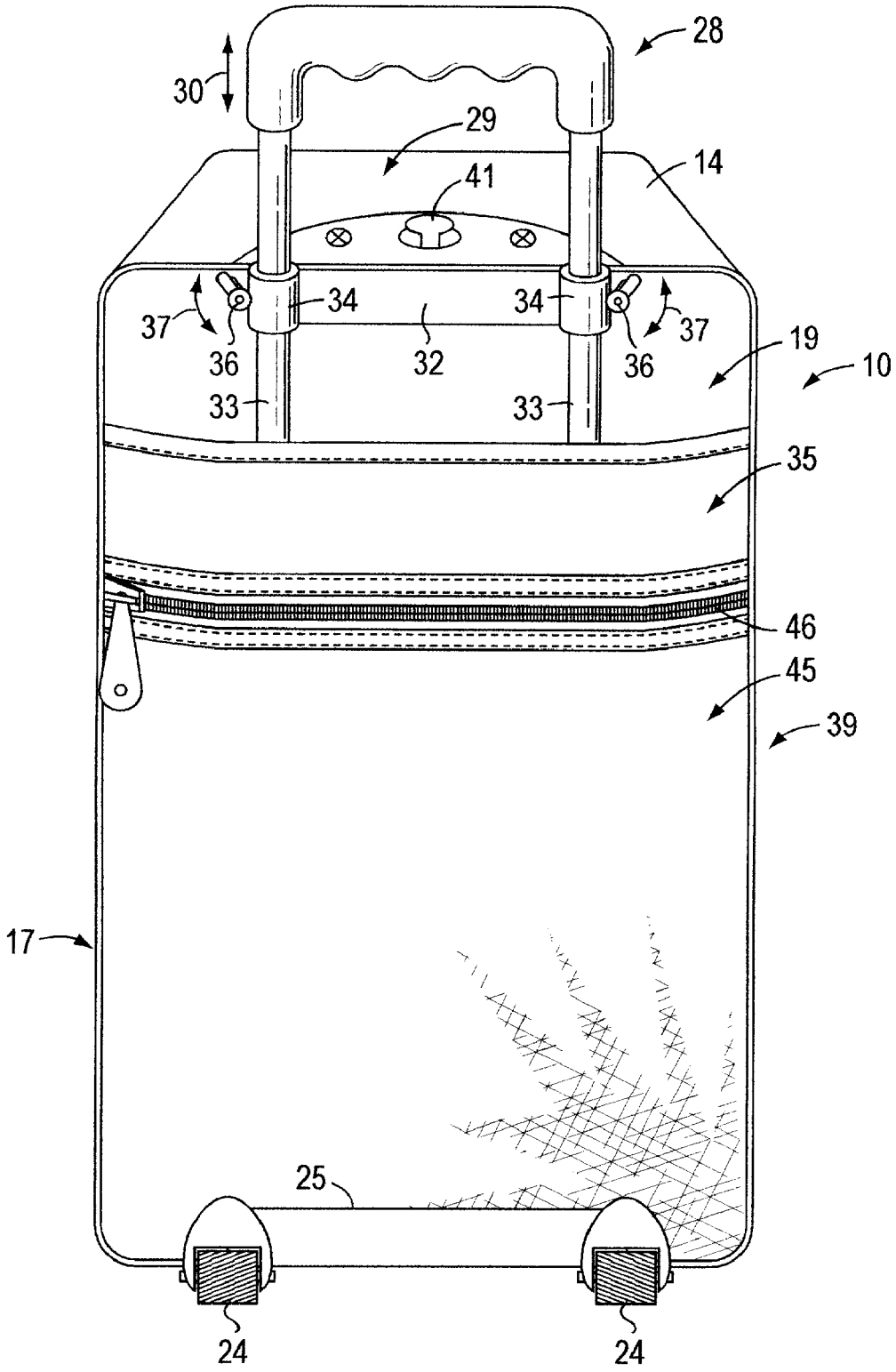
FIG. 2 is a rear perspective view of the luggage piece of FIG. 1.

FIG. 1 illustrates a luggage piece 10 of a type typically used by airline passengers as a carry-on bag. The luggage piece has an outer shell constructed from durable canvas, Cordura® or another durable spun or woven fabric. Alternatively a lightweight rigid outer shell can be utilized. With reference also to FIG. 2, a variety of outer pockets are provided on the luggage piece along with a roomy inner compartment (not shown in detail) of conventional design. The inner compartment is accessed through a zippered front panel 12 attached to the main body 14 of the luggage piece 10 by a heavy duty double zipper 16. The zipper 16 extends around the outer perimeter of the main body 14 to opposite edges 13 of the left elongated side of the body 14. The main body 14, which defines a rectangle about its perimeter, is rigid or semi-rigid to maintain its shape. Cardboard, fiberboard, or plastic stiffener material can be located under the fabric outer shell to provide rigidity to the main body. The front panel, and opposing rear panel 19 (see FIG. 2) can be constructed from flexible fabric only. In a preferred embodiment, the front panel also includes a wire insert (not shown) that maintains the rigid perimeter outline of the main body 14.

The left side 17 of the main body 14 has four plastic non-skid feet 18 for resting the luggage piece on its elongated side 17. A main base 20 enables the luggage piece to be stood with its elongated dimension upright (as shown). This base 20 supports a pair of feet 22 that are located opposite a pair of wheels 24. The wheels enable the luggage piece to be tilted rearwardly as shown by the curved arrow 26 and pulled along a floor surface by a retractable pull handle 28. The wheels can be attached to the base as part of a plastic support structure 25 (FIG. 2) that is riveted, screwed or otherwise joined to the underlying base material. The pull handle 28 is mounted to a plastic base member 32 located on the top side 29 of the main body. The base member 32 is secured to the top side 29 of the main body by screws, and extends downwardly onto the rear panel 19.

The pull handle 28 includes a pair of tubular support posts 33 that extend slidably through guide tubes 34 on the rear the base member 32. The posts are concealed, in part by an outer pocket 35 that overlays the bottom three-fourths of the rear panel 19. The pull handle 28 can be extended and retracted (double arrow 30) relative to the guide tubes 34 by releasing a pair of cam levers 36 on each of the guide tubes 34, respectively. Rotating (curved arrows 37) the cam levers 36 selectively applies locking pressure to the posts 33, enabling the pull handle 28 to be positioned at any point along its range of movement toward or away from the base member 32. A mushroom-shaped auxiliary hanging hook 41 is molded onto the top of the base member 32 for added convenience.

In general, the approximate dimensions of the luggage piece according to a preferred embodiment are as follows:

the elongated height H is of the main body 14 is twenty-two inches;

the width W of the main body 14 in the narrowed dimension fourteen and one-half inches; and the depth D of the main body 14 between the front and rear panels 12 and 19, respectively, is seven and one-half inches.

These dimensions can be varied as necessary to fulfill the particular mission of the luggage piece. The main body 14 includes a reinforced strip of woven material 38 that circumscribes the rectangular perimeter of the main body at its middle (approximately halfway along the depth D). This reinforcing strip 38 further strengthens the structure and adds an aesthetic detail. A woven handle 40 is attached to the top side 29 of the main body 14 over the reinforcing strip 38. Another similar handle (not shown) is centered on the right side 39 of the main body 14 over the reinforcing strip 38. The top side handle 40 enables the luggage piece 10 to be carried with the elongated height H upright. The right-side handle enables the luggage piece 10 to be carried with the narrower width W upright. All fabric joints in the luggage piece 10 are typically made by a conventional stitching process using high strength thread. Double and triple stitching can be used where desired. Attachments such as the wheels 24 and feet 18 and 22, as well as the handle 40 can be further attached using rivets, screws or other through-members. Adhesives and/or plastic welding processes can be used where appropriate.

An outside pocket 42 having a zipped opening 44 is provided on the front panel 12. This pocket 42 can be any size. Typically, it is eleven and one-half inches wide, six inches high and has a depth of three-quarter inch. The rear pocket 35 can also include a separate outer pocket 45 having a zipped enclosure 46, as shown in FIG. 2.

The lower portion of the front panel 12 includes the detachable tote bag 50 according to this invention. The tote bag 50 is formed from either a single or double-ply flexible fabric such as canvas or Cordura®. Such fabric is typically suitable for luggage applications, and is typically selected to complement or match the outer covering material of the luggage piece. The tote bag defines a single main pocket formed between two side sections of the material that are left open at the top. The tote bag 50 has the following dimensions in a preferred embodiment when laid flat:

the overall height H1 is thirteen and one-half inches;

the overall width W1 is 14 inches; and the depth is approximately the thickness of the two fabric layers that form the two sections, as described further below.

Figure 4:
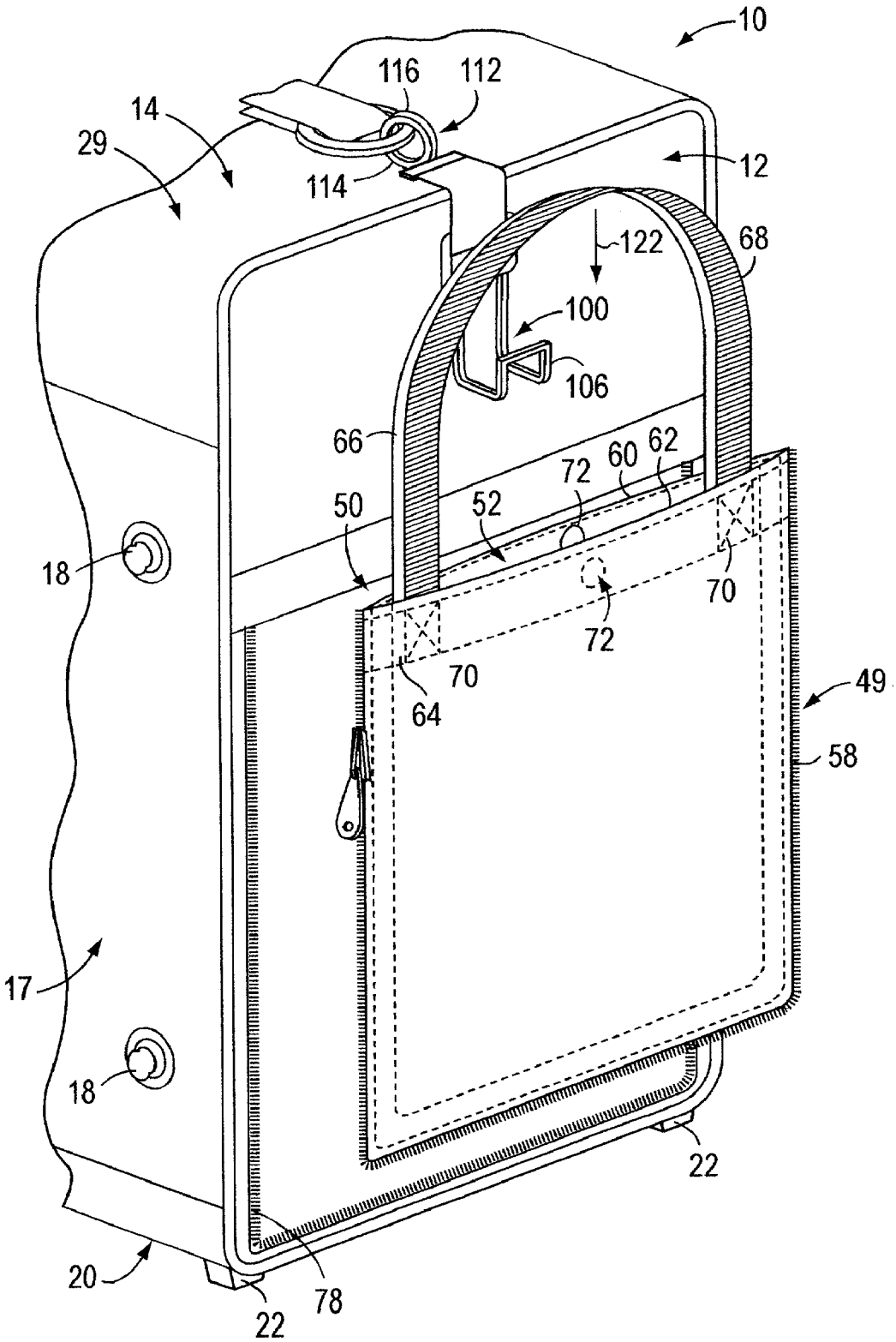
FIG. 4 is a perspective view of the placement of the tote bag, when removed, on a detachable hanging hook according to this invention.

The tote bag's dimensions are dictated, in part by the outer dimensions of the main body 14. This is because the tote bag 50 is removably attached to the lower half of the front panel 12 adjacent its outer perimeter. A closure structure secures the tote bag to the front panel. In a preferred embodiment, the closure structure comprises a "Number 5" ¾ inch nylon zipper that extends around the perimeter of the tote bag, from one corner 54 of the top opening 52 to the other corner 56 of the top opening. With reference also to FIG. 4, the tote bag is formed so that a first half 58 of the Number 5 zipper 49 is sewn between the two side sections 60 and 62 that make up the walls of the tote bag. The first zipper half 58 extends outwardly from the outer perimeter of the tote bag, with the zipper teeth placed in close proximity to the perimeter seam between the two side sections 60 and 62. Any acceptable stitch arrangement can be used for the seam, such as a basic single stitch or a double stitch. The seam are open at the top 52 allowing access to the inside of the tote bag through the opening thereby formed. Adjacent the opening is a double-stitched band 64 that can include a reinforcing strip, preferably along the interior face of each side section 60 and 62. Two reinforced woven handles 66 and 68 are attached by ample stitching 70 to each of the respective side sections 60 and 62. In transport, the handles 66 and 68 are loaded into down into the main pocket through the top opening 52 so that they rest within the interior of the tote bag as shown in phantom in FIG. 1. A snap closure 72 of any accepted has two interengaging halves attached to opposing inner faces of the two side sections, near the top opening 52. When joined together the snap secures the two side sections 60 and 62 to close the top 52 during transport. A separate snap 72 is used since the zipper 49 does not otherwise enclose the top 52.

The other half 78 of the Number 5 zipper 49 remains attached to the lower perimeter of the front panel 12. The perimeter outline of the tote bag 50 substantially matches the outline of the front panel when the tote bag side sections are flattened-out. When the tote bag perimeter is aligned with the lower perimeter of the front panel 12, the zipper halves 58 and 78 are positioned to mate to each other. The tote bag 50 to be easily attached and detached from the front panel 12 by moving the zipper around the perimeter. Note that the lead ends of the zipper halves are adapted for detachment from each other when the zipper is moved in reverse (e.g. to open the zipper) to completely separate the halves—in the manner of a ski jacket. The zipper half 78 remains attached to the front panel 12 when the tote bag 50 is removed from the underlying luggage piece 10. The zipper half 78 is permanently sewn to the front panel's outer seam.

Figure 3:
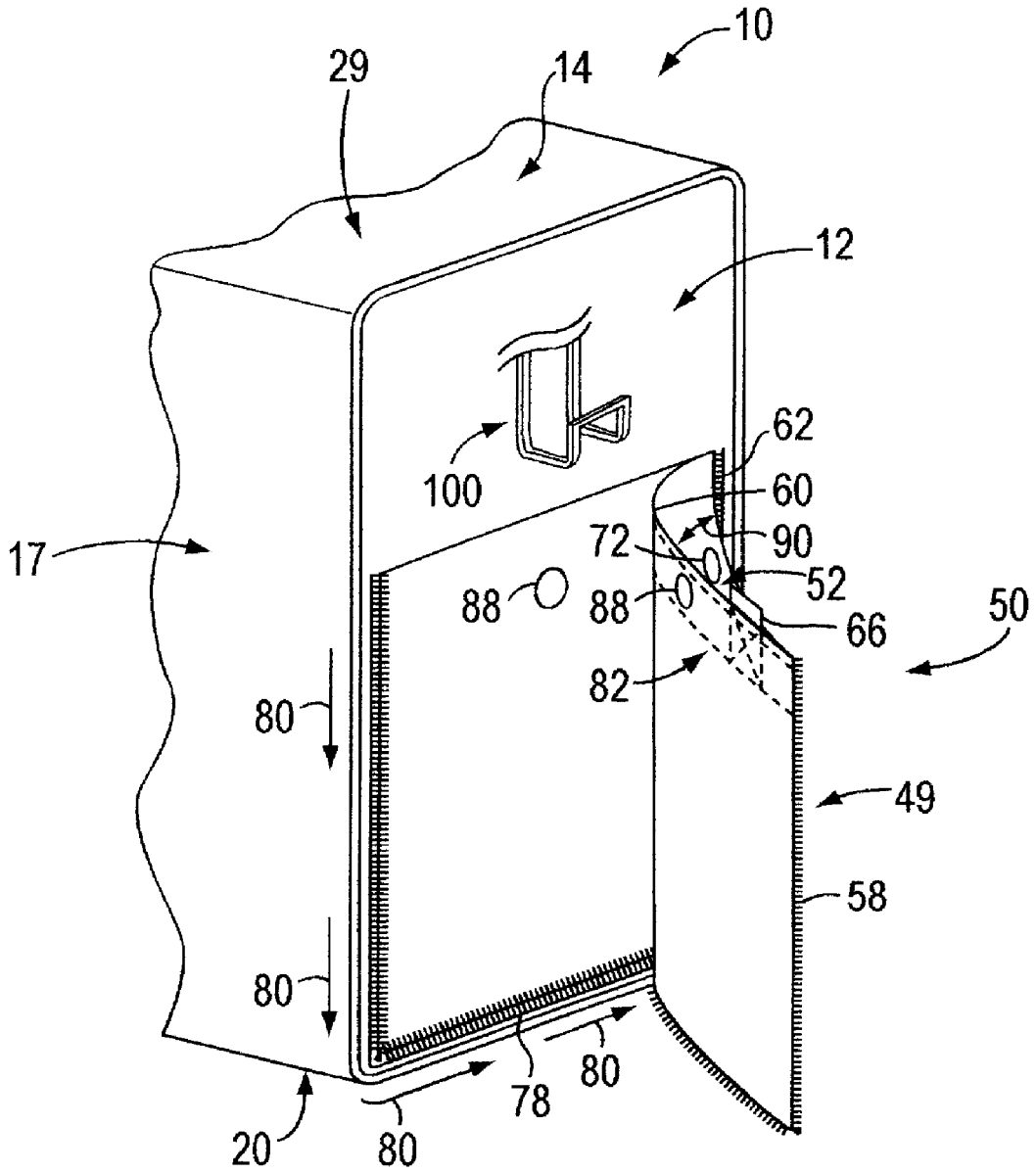
FIG. 3 is a somewhat schematic perspective view of the tote bag as it is being removed from the luggage piece according to this invention.

With reference to FIG. 3, removal of the tote bag from the front panel 12 is straightforward. The zipper is moved in reverse about the perimeter as shown by the arrow 80, releasing the tote bag zipper half 58 from the front panel zipper half 78. The bag is pulled away as shown by the arrow 82. An outer snap 88 is provided on the outer face of side section 60 of the tote bag. This outer snap 88 can be aligned with the interior snap 72. The tote bag's half of the interior snap 72 is secured to the inner reinforcing strip 64, and the tote bag's half of the outer snap 88 is secured to the fabric of the side section 60. The other half of the outer snap 88 is located in an aligned position on the front panel 12. The outer snap 88 maintains the tote bag top 52 firmly against the front panel 12 when it is zippered to the front panel. The outer snap prevents the top of the tote bag from "flopping" away from the front panel and becoming caught on an external object. Normal pressure exerted by a pulling hand can detach either of the snaps 72 or 88. Any acceptable snap arrangement or other closure structure can be used. When the outer snap 88 has been released, and the zipper has been moved fully in reverse around the perimeter, the tote bag is free of the front panel. The tote bag can be pulled open for use by detaching the interior snap 72, and spreading the two side sections 60 and 62 as shown by the double arrow 90. The handles 66 and 68 can then be accessed and withdrawn for use.

As detailed in FIG. 1, a removable hook 100 is provided according to a preferred embodiment. The hook can comprise a solid piece of sheet-steel or brass, or, as shown, the hook can comprise a continuous formed ring of rigid steel or brass wire. In one embodiment, the wire can have a diameter of approximately one-eight to three sixteenths of an inch. The hook 100 is formed into an elongated section 102 a base 104 and a forward hook 106. At the upper end of the elongated section, a woven strip of material 108 is wrapped therearound. The strip can be secured and/or adjusted for length with a buckle 110 according to an embodiment of this invention. In an alternate embodiment, the strip can be sewn into a loop around a conventional spring clip 112. The strip is, in general, formed from two plies of synthetic and/or natural webbing material that are joined together to form a loop. The spring clip 112 includes a locking portion 114 that can be moved to open against a spring pressure that maintains the clip in a closed orientation. By opening the clip 112, it can be selectively engaged to and released from a D-ring 116 that is joined to the main body 14 at the center reinforcing strip 38. A folded strip 118 is looped around the D-ring 116 and sewn to the underlying reinforcing strip 38. A rivet 120 is provided to the center of the strip 118 for further reinforcement. The spring clip 112 and D-ring 116 are, essentially, conventional in design and are formed from materials suitably strong for use in luggage. In general, one-eight-inch steel wire, formed to an appropriate "D" shape is sufficient for forming the D-ring 116. The spring clip 112 makes the hook assembly removable from the luggage when not in use. It can be tucked away into any convenient pocket of the luggage, such as the front outer pocket 42.

As detailed in FIG. 4, when the hook 100 is attached to the D-ring 116 it enables the handles 66 and 68 of the tote bag to be lowered onto the hook 100 as shown by the arrow 122. The handles 66 and 68 can be rested on the hook when the tote bag is not being carried separately. This hook arrangement enables the tote bag to be carried along with the luggage piece 10 when, for example, the luggage piece is moved by its wheels. Since the luggage piece tilts towards its rear face, the tote bag will lay, under force of gravity, against the front panel 12. The forward hook portion 106 of the hook 100 is approximately one-inch high in a preferred embodiment. This height is sufficient to prevent the handles 66 and 68 from climbing out of the hook. Likewise, the width of the bottom section 104 is between one inch and one and one-half inch. This bottom section dimension is approximately the same as the width of each of the handles, enabling a secure, relatively slide-free fit.

The foregoing has been a detailed description of a preferred embodiment of the invention. Various modifications and additions can be made without departing from the spirit and scope of the invention. For example, the dimensions of the bag can be varied. The zippered tote bag can be provided so that it conforms with a potion of the perimeter of a face of the bag. Alternatively, the tote bag can be mounted so that it fits within, and remote from, the perimeter of one of the faces, by mounting the luggage piece's half of the zipper remote from the perimeter edge. A variety of internal pockets and separators can be provided to the tote bag by stitching further layers of material between the two outer surfaces. A zipper or multiple closures, rather than a single snap can be provided to enclose the top of the tote bag and to secure the top to the front panel. Similarly, in an alternate embodiment, the perimeter zipper that secures the tote bag to the luggage piece can be substituted for another closure mechanism such as a long Velcro strip (or strips) or a series of snaps disposed about the perimeter of the tote bag that engage conforming snaps on the surface of the luggage piece. Likewise, the tote bag's zipper half can be mounted to another part of the tote bag surface, or multiple zippers can be used to join the tote bag to the luggage piece. In particular, the tote bag's zipper half can be mounted to the perimeter of the tote bag in a different manner than between the side sections. Similarly, the luggage piece can include a variety of other pockets and structures for adding to the convenience of a user. Finally, the tote bag can be attached at another location on the front panel or to another side of the luggage piece. Accordingly, this description is meant to be taken only by way of example, and not to otherwise limit the scope of the invention.

What is claimed is:

1. A luggage piece comprising:

a plurality of sides enclosing a luggage compartment, at least one of the plurality of sides comprising a flexible fabric material and including, on a portion thereon, a first zipper half of a pair of separable zipper halves extending about a portion of the surface from a first point to a second point;

a tote bag having a pair of opposing flexible fabric material side sections joined together about a perimeter, the side sections being unjoined along at least a portion of one edge therebetween and thereby defining an opening therebetween, the perimeter including a second zipper half of the pair of separable zipper halves that is aligned with and interengages the first zipper half on the one of the plurality of sides when the side sections of the tote bag are laid substantially flat;

a pair of loop handles respectively extending from, and attached to, each of the side sections of the tote bag at the opening therebetween; and a first half of a closure structure located adjacent the opening between the first point and the second point on the one of the plurality of sides having the first zipper half, and an interengaging second half of the closure structure located adjacent an outer-facing face of one of the side sections of the tote bag in alignment with the first half of the closure structure.

2. The luggage piece as set forth in claim 1 wherein one of the plurality of sides includes a pair of wheels, and the luggage piece further comprising a pull handle for pulling the luggage piece along a surface on the wheels.

3. The luggage piece as set forth in claim 2 further comprising at least one outer pocket located on at least one of the plurality of sides.

4. The luggage piece as set forth in claim 3 further comprising a hook detachably mounted to a top side of the plurality of sides and extending along one of the plurality of sides, the hook being constructed and arranged to receive the loop handles of the tote bag.

5. The luggage piece as set forth in claim 4 wherein the wheels are located on a bottom side of the plurality of sides opposite the top side and the wheels being adjacent a rear side of the plurality of sides, and wherein the hook extends along a front side opposite the rear side, whereby tilting of the luggage piece about the wheels causes the tote bag to lay under gravity against the front face.

6. The luggage piece as set forth in claim 5 wherein the first zipper half is located on the front side.

7. The luggage piece as set forth in claim 1 wherein the first half of the closure structure comprises a first snap closure piece and the second half of the closure structure comprises a mating second snap closure piece.

8. The luggage piece as set forth in claim 7 wherein each of the side sections of the tote bag include, adjacent the opening, opposing, facing interengaging snap closure halves for securing closed the opening at desired times.

9. The luggage piece as set forth in claim 8 wherein the closure structure is located on a front side of the plurality of sides and wherein the front side includes a main closure structure located about a portion of a perimeter thereof constructed and arranged to allow a portion of the front side to be separated from luggage piece for access to the luggage compartment.

* * * * *